US006982399B1

(12) United States Patent
Hunts

(10) Patent No.: US 6,982,399 B1
(45) Date of Patent: Jan. 3, 2006

(54) SLOT ENTRY TOWEL WARMER

(76) Inventor: Barney Dean Hunts, 17 Reeve Ave., Stanhope, NJ (US) 07874

( * ) Notice: Subject to any disclaimer, the term of this patent is extended or adjusted under 35 U.S.C. 154(b) by 24 days.

(21) Appl. No.: 11/036,117

(22) Filed: Jan. 14, 2005

(51) Int. Cl.
*F27D 7/04* (2006.01)
*F26B 9/06* (2006.01)

(52) U.S. Cl. ..... 219/400

(58) Field of Classification Search ..... None
See application file for complete search history.

(56) References Cited

U.S. PATENT DOCUMENTS 4,644,136 A * 2/1987 Watchman ..... 219/400
4,918,290 A * 4/1990 DeMars ..... 219/400
5,842,287 A * 12/1998 Murphy ..... 34/202
6,046,436 A * 4/2000 Hunts ..... 219/400
6,525,298 B1 * 2/2003 Hunts ..... 219/400

* cited by examiner

*Primary Examiner*—Joseph M. Pelham

(57) ABSTRACT

A towel warmer heated by either forced hot air or microwave energy comprising a trapezoidal substantially airtight enclosure having a minimal vertical dimension access door consistent with bathroom vanities and free standing nursery towel cabinets to enable placing a towel to be warmed in the enclosure and to enable removing the warmed towel there from; an inclined shelf disposed within an inner rhomboidal cavity to support the towel and inclined from front to rear in order to facilitate insertion of the towel; an electrical control circuit disposed within the enclosure to automatically control the heating process for a given period of time or until the access door is opened, whichever occurs first and an operator friendly electronic control system which anticipates the users intent without the need for external pushbuttons.

4 Claims, 6 Drawing Sheets

SLOT ENTRY TOWEL WARMER

BACKGROUND OF THE INVENTION

The present invention relates to bathroom towel warmers and more particularly to improved towel warmer configurations intended for installation in close proximity to a bathtub or shower enclosure to assure their accessibility to the user.

As pointed out in U.S. Pat. Nos. 6,046,436 and 6,525,298, whose patentee is the same as the applicant of the present application, the feel of a warm towel against the skin immediately after a shower or bath is a delight, but experience has shown that the pleasure diminishes rapidly as the distance from the tub or shower to the towel warmer increases. To be commercially viable, a towel warmer must be esthetically pleasing, space economical, and easily accessible within close reach of the tub or shower.

A difficulty in acceptance arises because a large portion of already existing bathrooms were built with a priority given to space efficiency, they are dimensionally small with restricted ability to add additional cabinetry. Further complicating the marketplace, cabinetry manufacture for installation in current housing construction is done to standard dimensions on large volume production lines, new devices are adapted only when they fit these standard dimensions. These preexisting conditions and limitations invoke the necessity that a multiplicity of physical configurations and possible installation options become available if full immersion towel warmers are to be widely utilized. Of particular interest is the typical five inch vertical opening dimension of the top drawer of a vanity.

It is applicants desire to provide prospective users with a choice of compact, esthetically attractive warming devices for installation in a bath or shower area, any one of which is equally capable of achieving rapid, uniform heating of articles such as clothing or towels and the like as a preliminary to use. In order to be as unobtrusive and aesthetically pleasing as possible it is preferable to minimize the degree to which the towel warmer protrudes into the room. In some bathroom remodeling and new construction it may be preferable to embed a permanent towel warmer between the wall studs. In all instances the selected towel warmer must be capable of heating or warming uniformly through multiple layers of plush towels within a short period of time, namely within the few minutes required to take a bath or shower.

BRIEF SUMMARY OF THE INVENTION

An object of the present invention is to provide a rapid response, safe, total immersion towel warmer within an existing, area restricted bathroom and in close proximity to a tub or shower. A further object of the present invention is to minimize the protrusion of access doors, drawers and/or rotating towel chambers into the free space of the bathroom.

An additional object of the present invention is to provide a forced hot air towel warmer having physical and geometrical dimensions consistent with installation either within the restricted vertical dimension of the uppermost drawer of industry standard bathroom cabinetry or an equivalent uppermost apparent drawer of a free standing cabinet, both while presenting minimal protrusion into the bathroom space.

An additional object of the present invention is to provide a towel warmer which circumvents the difficulty of achieving sufficient air pressure and flow volume using low noise fan blowers to force air through folded towel fabric by selecting an alternative method of total immersion heating, in which heating of each individual towel fiber is accomplished by the use of microwave energy to excite the moisture adsorbed on the fiber surface or absorbed within the fiber. A further advantage of a microwave powered towel warmer is more efficient space utilization stemming from the elimination of the need for air handling ducts and/or plenums.

A feature of the present invention when used within free standing or industry standard bathroom cabinetry is the provision of a trapezoidal hot air towel warmer comprising a substantially airtight trapezoidal enclosure having a sealable access means to enable placing a towel and the like to be warmed in the substantially airtight trapezoidal enclosure and to enable removing a warmed towel there from; first means disposed within the substantially airtight trapezoidal enclosure consists of a rhomboidal cavity inclined front to back to hold the towel to be heated; second means disposed within the substantially airtight trapezoidal enclosure consisting of a shelf having air passages there through to support the towel and inclined front to back to promote easy insertion and removal of the towel; third means disposed within the substantially air tight trapezoidal enclosure adjacent the second means, containing a temperature sensor and comprising a constant temperature antechamber in which a volume of pressurized air maintained within a predetermined temperature range is caused to continuously impinge on the towel to be heated; fourth means disposed within the substantially air tight trapezoidal enclosure adjacent the third means to heat the stream of air; fifth means disposed within the substantially air tight trapezoidal enclosure adjacent the fourth means to pressurize and continuously circulate a stream of air within the substantially air tight trapezoidal enclosure for passage through the first means and the towel; sixth means disposed within the substantially airtight trapezoidal enclosure having air passages there through to allow air to pass freely upon exiting the towel and inclined from front to rear so as to create a return air plenum and provide an increased height volume at the rear of the unit to house means four, five and six while presenting the user with a minimal frontal profile; seventh means consisting of electronic control circuitry for timing and temperature control, the temperature sensor contained within the third means, and switches to detect movement of the sealable access means.

Another independent feature of the present invention is heating of towels by microwave energy absorption in which the individual towel fibers are heated by exciting the water molecules adsorbed thereon by microwave radiation this feature comprising a trapezoidal substantially air tight, microwave radiation tight enclosure having a sealable access means to enable placing a towel and the like to be warmed in the substantially air tight, microwave radiation tight enclosure and to enable removing a warmed towel there from; eighth means disposed within the substantially airtight, microwave radiation tight enclosure consisting of a rhomboidal cavity to hold the towel to be warmed and having dimensions consistent with a uniform microwave energy field; ninth means disposed within the eighth means consisting of a shelf to support the towel and having there under a displacement sensor to detect the weight of the towel; tenth means disposed adjacent the substantially air tight, microwave radiation tight enclosure consisting of a magnetron to create a microwave energy field and to impinge the microwave energy substantially uniformly upon the towel held within the eighth means and thereby heat the towel; eleventh means disposed adjacent the air tight, microwave radiation tight enclosure consisting of safety interlock, sequence timing and power level control circuitry; twelfth means consisting of a cooling fan and associated intake/exhaust openings; thirteenth means consisting of a user selectable touch pad to indicate medium or large towel size is an alternative to the ninth means shelf and displacement sensor as a method to control the duration of full microwave power application.

BRIEF DESCRIPTION OF THE SEVERAL VIEWS OF THE DRAWING

Above-mentioned and other features and objects of the present invention will become more apparent by reference to the following description taken in conjunction with the accompanying drawing, in which.

DETAILED DESCRIPTION OF THE INVENTION

Figure 1:
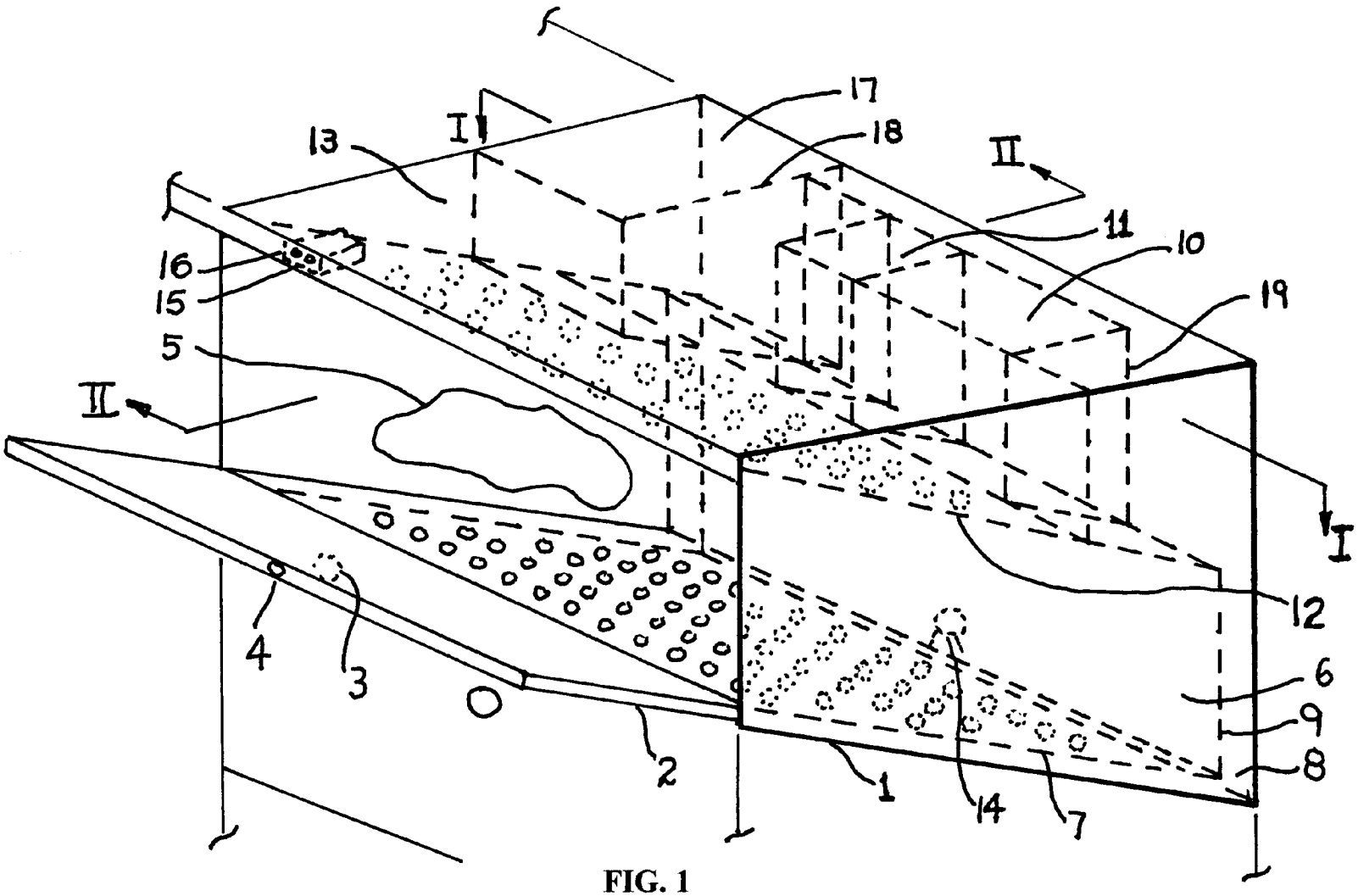
FIG. 1 is a perspective view of the trapezoidal hot air towel warmer embedded in a bathroom cabinet in accordance with the principles of the present invention.
Figure 3:
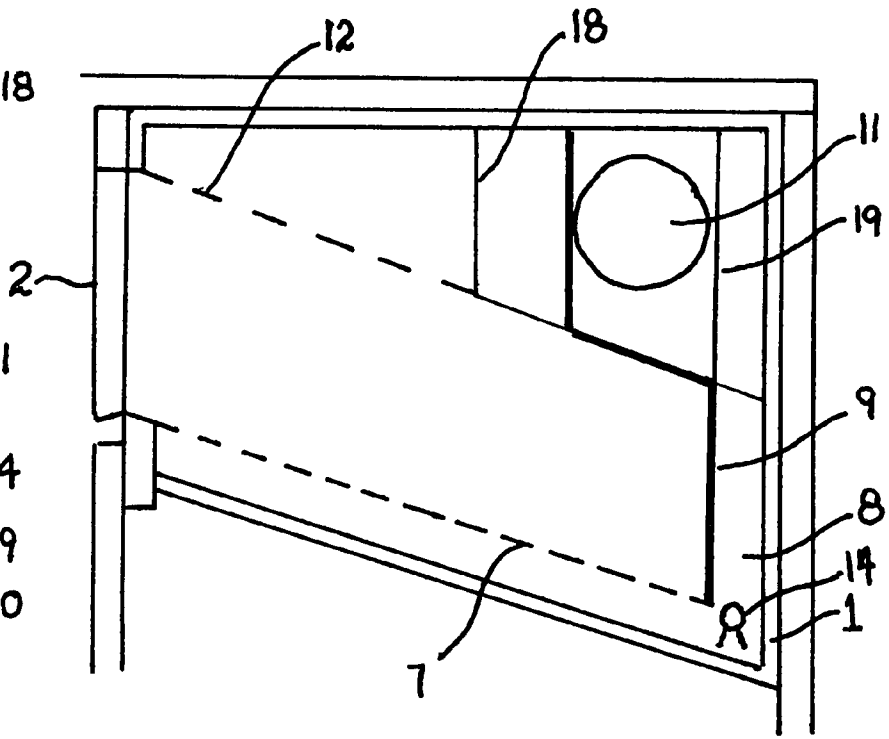
FIG. 3 is a cross sectional view of the trapezoidal hot air towel warmer taken along line II—II of FIG. 1.
Figure 2:
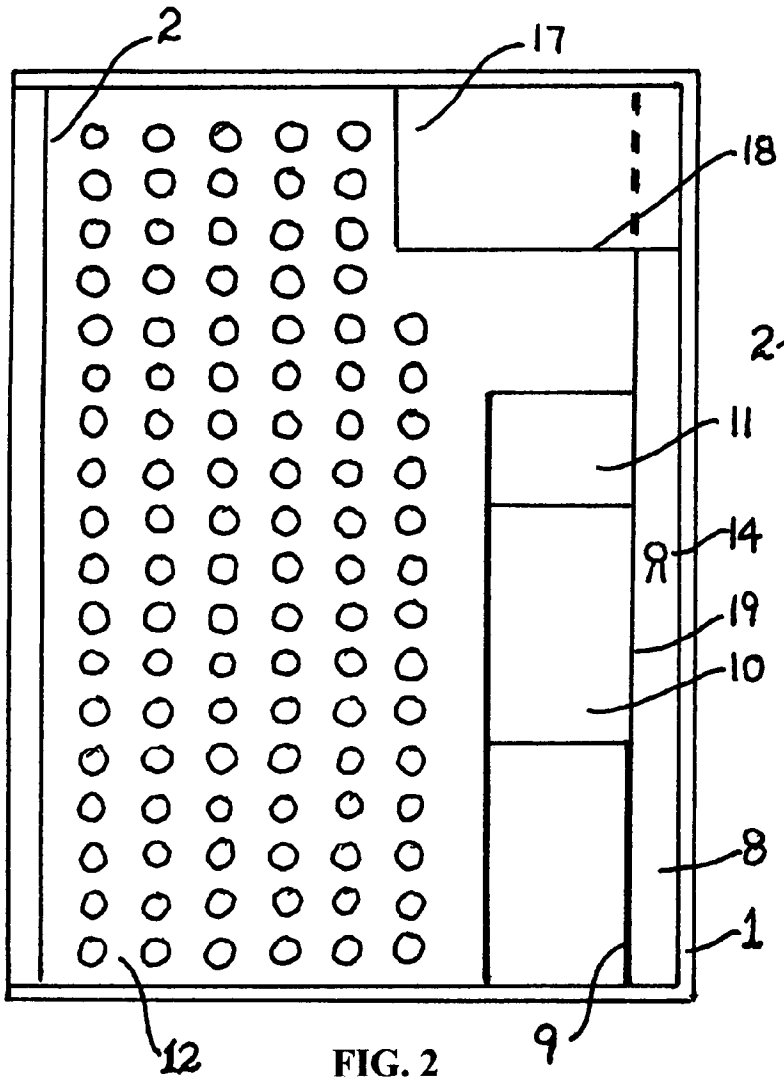
FIG. 2 is a cross sectional view of the trapezoidal hot air towel warmer taken along line I—I of FIG. 1.

Referring to FIGS. 1, 2 and 3, the trapezoidal hot air towel warmer in accordance with the principles of the present invention includes a substantially air tight trapezoidal enclosure 1 having a sealable access means in the form of a door 2 which is moveable into a closed position by handle 3 and held in a closed position by a magnet 4 or similar catches. Door 2 enables a towel 5 to be warmed to be placed in the enclosure 1 and to enable removing the warm towel 5 from enclosure 1. The towel is preferably folded in order to ease the actual insertion, whether folded or crumpled the towel is completely warmed throughout its bulk by means of total immersion in the temperature controlled forced hot air being circulated within enclosure 1.

A first means in the form of a rhomboidal cavity 6 sloped from front to back is disposed within the air tight trapezoidal enclosure to hold the towel to be heated.

A second means in the form of shelf 7 inclined front to back to promote easy insertion of the towel to be heated and having smooth finely perforated air passages throughout is disposed within the air tight enclosure 1 to support the towel 5.

A third means 8 disposed within the substantially air tight trapezoidal enclosure adjacent the second means, contains a temperature sensor and comprises a constant temperature antechamber in which a volume of pressurized air maintained within a predetermined temperature range is caused to continuously impinge on the towel to be heated. The bottom, rear and small portions of the top and side walls of the trapezoidal enclosure form the corresponding walls of this antechamber 8, with its front wall being defined by the internal bulkhead 9 together with bulkhead 19 which forms the rear and top walls of heater 10 and blower 11 respectively.

A fourth means in the form of a resistance coil heater 10 is disposed within the substantially air tight trapezoidal enclosure adjacent the third means to heat the air stream and hence the towel 5.

A fifth means in the form of a blower 11 is disposed within the substantially air tight trapezoidal enclosure adjacent the fourth means to pressurize and continuously circulate a stream of air within the substantially air tight trapezoidal enclosure for passage through the first means and the towel therein.

A sixth means consisting of a baffle 12 disposed within the substantially airtight trapezoidal enclosure having air passages there through to allow air to pass freely upon exiting the towel and inclined from front to rear so as to create both the top of the rhomboidal towel cavity 6 plus a return air plenum 13 and to simultaneously provide an increased height volume at the rear of the unit to house means four, five and seven while presenting the user with a minimal frontal profile.

The first means rhomboidal cavity in which the towel is heated is defined by the access means door 2, second means shelf 7, internal bulkhead 9, sixth means baffle 12, and the side walls of the substantially airtight trapezoidal enclosure 1.

A seventh means consisting of the temperature sensor 14 contained within the third means 8, the door open and close sequential switches 15 and 16 to detect movement of the sealable access means 2, and electronic control circuitry 17 contained within enclosure 18 for timing and temperature control. Enclosure 18 is a six sided essentially air tight self contained enclosure used to provide moderate thermal isolation between the electronic components contained therein and the heated air stream. Bulkhead 19 together with bulkhead 9 and enclosure 18 completes the isolation between the forced hot air in the constant temperature antechamber 8, and the return air within the return air plenum 13.

Figure 4:
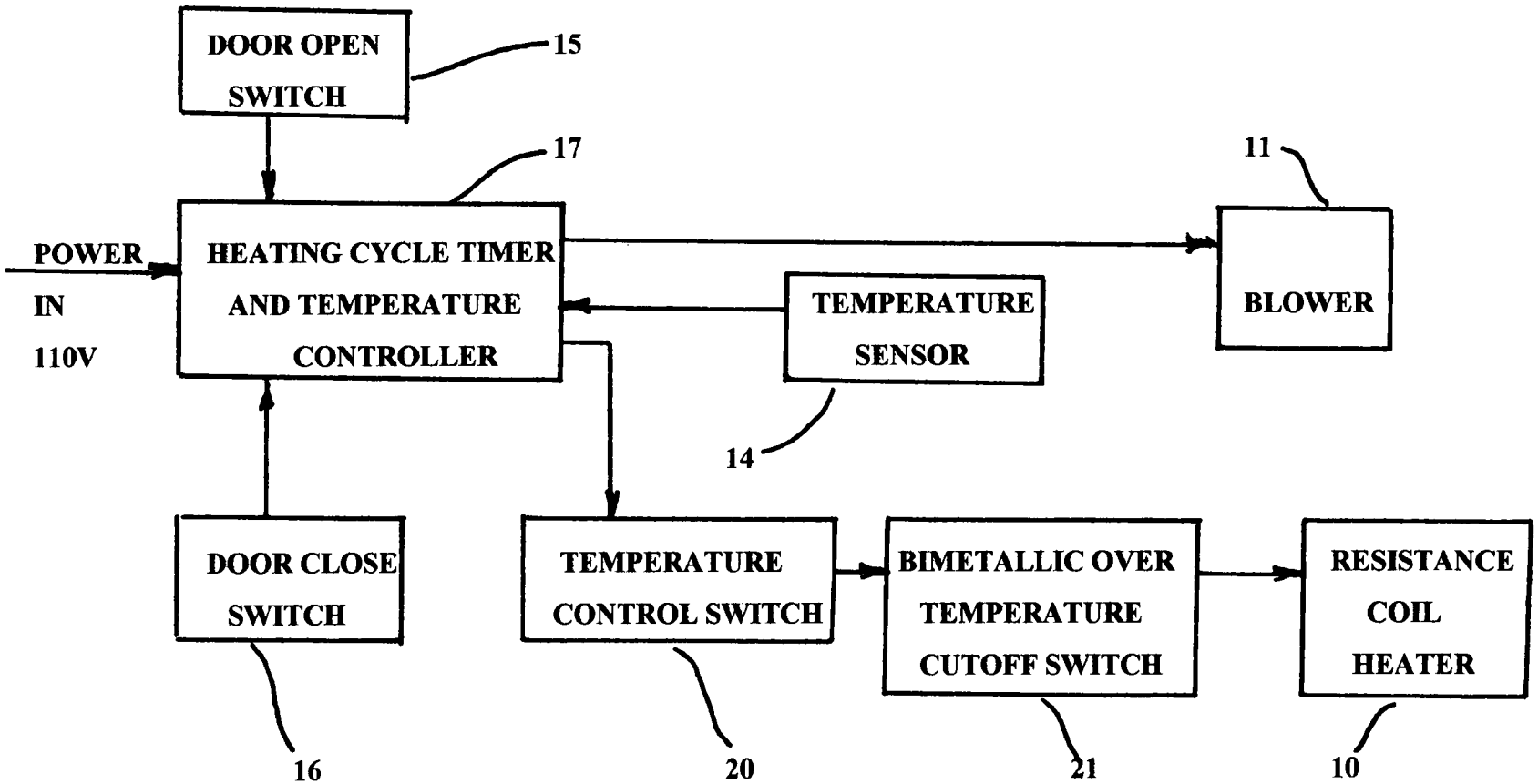
FIG. 4 is a block diagram of the electrical control system of the trapezoidal hot air towel warmer in accordance with the principles of the present invention.

The operation of the trapezoidal hot air towel warmer, in accordance with the principle of the present invention, is controlled be an electrical circuit, shown in block diagram form in FIG. 4 which together with temperature sensor 14, placed within the constant temperature antechamber 8 constitutes the seventh means of the device to automatically maintain the stream of air at a temperature within a predetermined "constant" temperature range for a given period of time.

Referring to FIG. 4, the main control to establish the predetermined time and temperature range is provided by the heating cycle timer and temperature controller 17 which includes therein electrical circuitry to provide a predetermined period of time to determine the users intent, a predetermined period of time for the heating cycle and a predetermined temperature range for the stream of air within antechamber 8. Controller 17 couples the power for operation of the resistance coil heater 10 and blower 11 for a predetermined period of time established by any known timer circuit and an electrical circuit that establishes the range of temperature within which it is desired to maintain the stream of air to accomplish the heating of towel 5. A "potential" heating cycle is initiated by the start switch 15, a normally open switch (during door 2 closed intervals) being actuated (closed) when the door 2 opens thus starting a short duration, on the order of three seconds, timer within the electronic controller 17. If the door is subsequently closed within this short time duration, door switch 16, a normally closed switch (during door closed intervals) and which had previously opened when the door 2 was opened, closes, starting an "actual" heating cycle. If the door does not close within this short time interval the control electronics assumes the users intent was to insert or extract a towel and an "actual" heating cycle does not occur. It is noted that switches 15 and 16 are break before make, that is, upon opening the door switch 16 opens before switch 15 closes and similarly when the door is closed switch 15 opens before switch 16 closes. This heating cycle will continue until either the user opens the door 2 to remove the towel, or the maximum heating time is reached and the heating cycle is automatically terminated by the controller 17. The controller couples power to the blower 11 throughout the heating cycle without interruption, with the power to the heater 10 being interrupted by the temperature control switch 20 and/or the bimetallic over temperature cutoff switch 21, only temperature control switch 20 being under direct control of and subject to interruption by temperature controller 17. A temperature sensor 14 is located in the path of the stream of air in close proximity to where it first encounters the towel such that it measures the hottest temperature applied to the towel. By this means, a temperature high enough to achieve rapid heat transfer to the towel can be maintained within the antechamber 8 without any danger of scorching the towel. The bimetallic over temperature cutoff switch 21 is located within the coils of the resistance coil heater, it will temporarily remove power to the heater coils if the blower fan ceases to function or if insufficient air passes through the heater coils to cool them within their proper operating temperature range.

The control arrangement as shown in FIG. 4 is such that during a heating cycle the controller 17 will supply power continuously to blower 11 as well as power to the resistance coil 10 which will be interrupted by the temperature control switch when the temperature of the air stream reaches the maximum desired level, the power to the resistance coil will then be restored when the air temperature drops approximately 5 degrees to its lower desired level thus establishing a predetermined temperature range. The maximum time of the heating cycle is selected to be longer than the time consumed by a normal shower or bath so that the warm towel will be available to the occupant of the shower or bath whenever they complete the shower or bath, but the unit will "timeout", shutting off all power automatically should the individual fail to open the access door 2 for any reason.

The door open switch 15 and door close switch 16 are embedded within the return air plenum and actuated upon opening the door, they are not directly available to the user and are thus "transparent" to the user. The user does not have direct access to any electrical switch but controls the operation of the towel warmer exclusively by means of the controller logic through manipulation of the access door 2.

Figure 5:
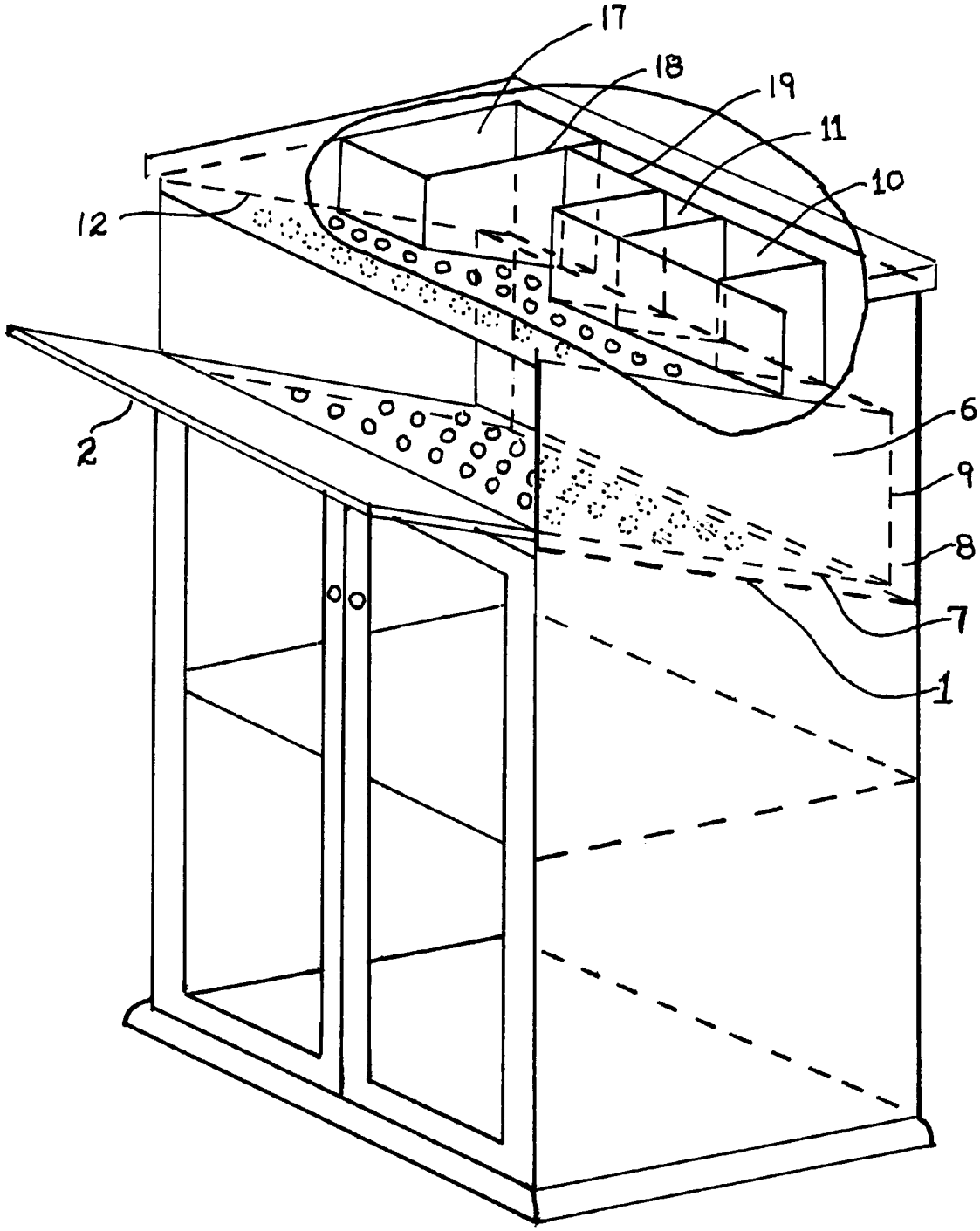
FIG. 5 is a perspective view of a trapezoidal hot air towel warmer embedded in a stand alone cabinet in accordance with the principles of the present invention.

Referring to FIG. 5, the trapezoidal hot air towel warmer in accordance with the principles of the present invention is illustrated therein embedded within a free standing cabinet, in this case a towel caddy having glass doors to allow observation of its contents. The height of the rear portion of the top shelf is foreshortened by the trapezoidal enclosure but experience has shown this to be of little consequence.

Figure 6:
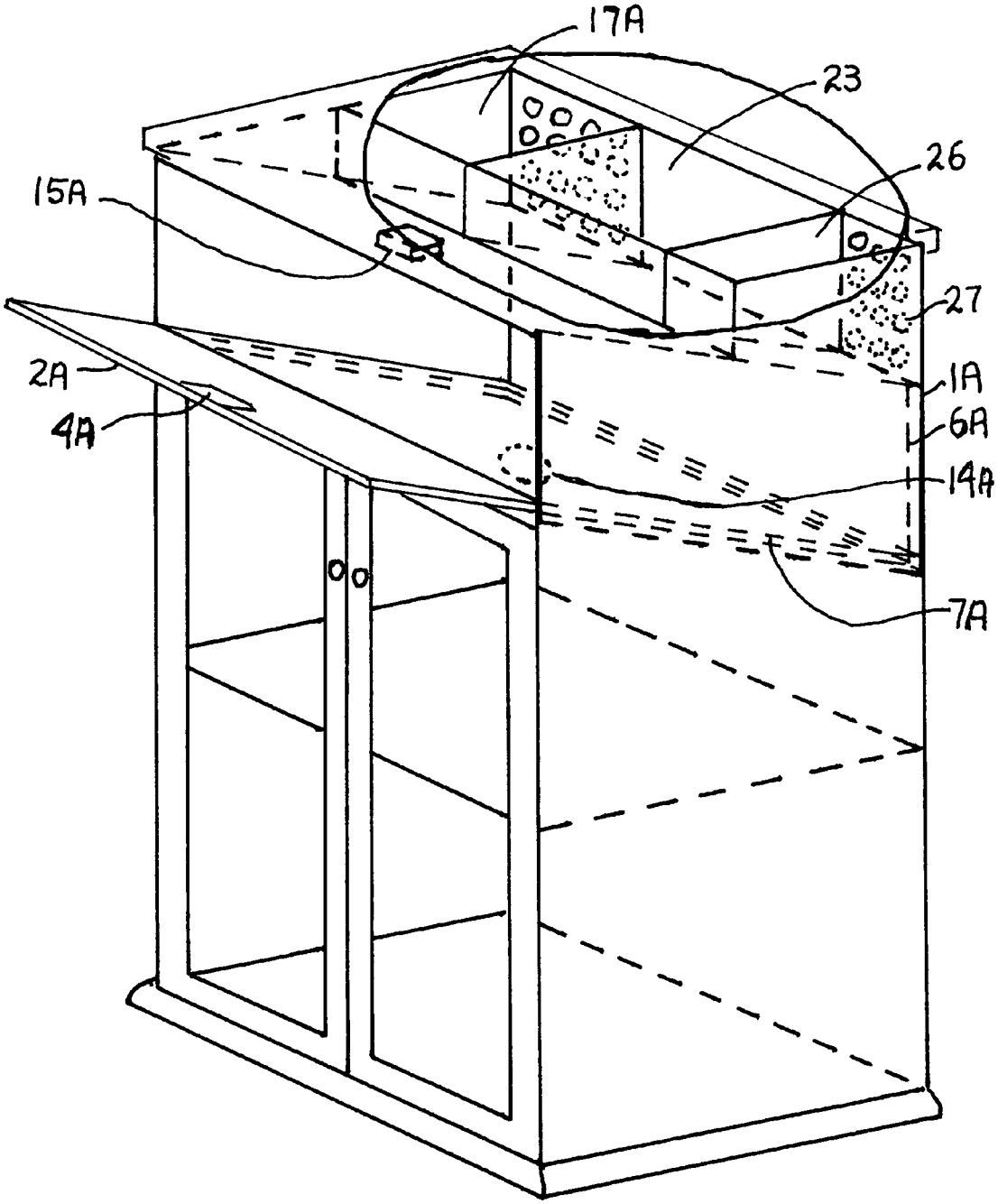
FIG. 6 is a perspective view of a trapezoidal microwave heated towel warmer embodiment embedded in a stand alone cabinet in accordance with the principles of the present invention.

Referring to FIG. 6, the microwave powered towel warmer in accordance with the principles of the present invention is illustrated therein embedded within a free standing cabinet which includes a substantially air tight metallic outer trapezoidal enclosure 1A having a sealable access means in the form of a door 2A which is moveable into a closed position and held in a closed position by a safety interlock latch 4A. The microwave powered towel warmer, unlike a hot air towel warmer, is a grounded system in which the outer metallic enclosure 1A and door 2A must be connected to earth ground through a three wire ground electrical circuit, also door 2A in this embodiment is metallic and opaque since there is no requirement for viewing through the door as in consumer microwave ovens. Door 2A enables a towel 5 to be warmed in the internal enclosure 1A and to enable removing the warm towel 5 from enclosure 1A. The towel is preferably folded prior to insertion in order to aid this action, whether folded or crumpled the towel is completely warmed throughout its bulk by means of total immersion in the microwave energy field being circulated within enclosure 1A.

An eighth means in the form of a rhomboidal cavity 6A sloped from front to back is disposed within the air tight trapezoidal enclosure to support the towel to be heated, said rhomboidal cavity having appropriately located access opening to allow entry of microwave energy and having dimensions consistent with a uniform microwave energy field.

A ninth means disposed within the substantially air tight, microwave radiation tight inner enclosure consists of a shelf 7A to support the towel and having there under a sensor 14A, in the form of a capacitive displacement, pressure or proximity sensor or any such sensor capable of detecting small physical displacement, for use in determining the approximate weight of the towel in order to adjust the time interval during which full power is imposed on the towel.

A tenth means disposed adjacent the substantially air tight, microwave radiation tight inner rhomboidal enclosure consisting of a magnetron 23 to create a microwave energy field and to impinge the microwave energy substantially uniformly upon the towel held within the eighth means and thereby heat the towel;

An eleventh means 17A, consisting of a low voltage power supply, microprocessor, and timing circuitry and which uses the door open switch 15A to determine the status and actuation timing of the safety interlock latch 4A, is contained within the space between the inner rhomboidal microwave cavity 6A and the outer metallic enclosure 1A, this means determines power on timing and power level control;

A twelfth means disposed adjacent the tenth means magnetron 23 consisting of a cooling fan 26 and associated intake and exhaust openings 27 to allow cooling air to enter, flow over the electronic controls and low voltage power supply 17A, then over and around the magnetron 23, and then to exit the enclosure.

A thirteenth means consisting of a two position touch pad 22 on the front of the outer metallic enclosure provides an alternative method of controlling the length of time power is imposed on the towel by enabling the user to indicate a medium or large designation for the towel to be warmed given an automatic system default level of small;

All current readily available consumer microwave ovens having similar heating and oven capacity incorporate essentially identical microprocessor controllers, low voltage power supply, power control circuitry, and frequency conversion magnetrons The smallest of these ovens having an internal heating cavity of 0.7 cubic feet is capable and has been demonstrated to heat towels in accordance with the principle of the present invention. The low voltage power supply, microprocessor and magnetron microwave power generator of the trapezoidal microwave powered towel warmer is expected to be provided by off the shelf microwave oven power units which are in current production without modification, only a modified control algorithm is required for the microprocessor.

What is unique in the microwave towel warmer is the simplified microprocessor control algorithm which eliminates the need for a multipurpose keypad and all operator options selectable thereby. This simplified algorithm together with displacement sensor 14A, placed within the towel heating cavity 6A, or alternatively the operator selected touch pad 22, constitutes the eleventh means of the device to start and stop the heating cycle and to adjust the time duration of full microwave power impingement according to the size and weight of the towel to be warmed. The microprocessor determines the position and time sequencing of the safety interlock latch 4A by means of the door switch 15A, interrogates the position of the displacement sensor 14A or, alternately, the operator designated towel size indicated by touch pad 22. The microprocessor establishes a predetermined maximum operating time and the portions of this time during which full microwave power, 100% duty cycle, is applied with a "keep warm" reduced power level, around 50% duty cycle, being applied for the remainder of the maximum operating time or until the user opens the door 2A to remove the towel terminating the power on cycle, whichever occurs first.

The "normal" condition of the warmer consists of having the access door closed and all power off. As with the hot air warmer previously described, opening the access door 2A initiates a hardware three second timer and power supply. The microprocessor upon being powered up starts an independent internal clocked three second timer and proceeds as follows: if the door is closed within the three second interval the microprocessor turns on the full system including its low voltage and microwave power and maintains this until the operator opens the door to remove the towel or until reaching the preprogrammed power on maximum time limit, whichever occurs first, at which time it turns all power to the system off; if the door is not closed within the three second interval the microprocessor will not turn the full system on and with the hardware timer "timing out" the warmer reverts to its "normal" all power off state regardless of when the door is subsequently closed.

Note that the door open switch 15A associated with the safety interlock latch 4A is used to immediately stop excitation of the magnetron and thus terminate the heating cycle at any time the operator begins to lift the latch 4A and prior to the door 2A opening, thus preventing the operator from ever being subject to stray microwave radiation.

Figure 8:
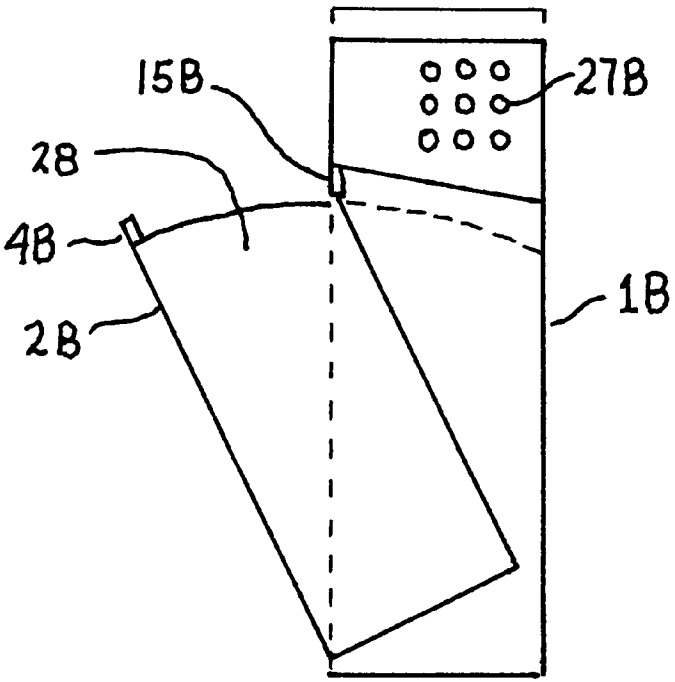
FIG. 8 is a side view of the microwave heated rock out cavity towel warmer indicating the position of the cavity preparatory to towel insertion and/or extraction.
Figure 7:
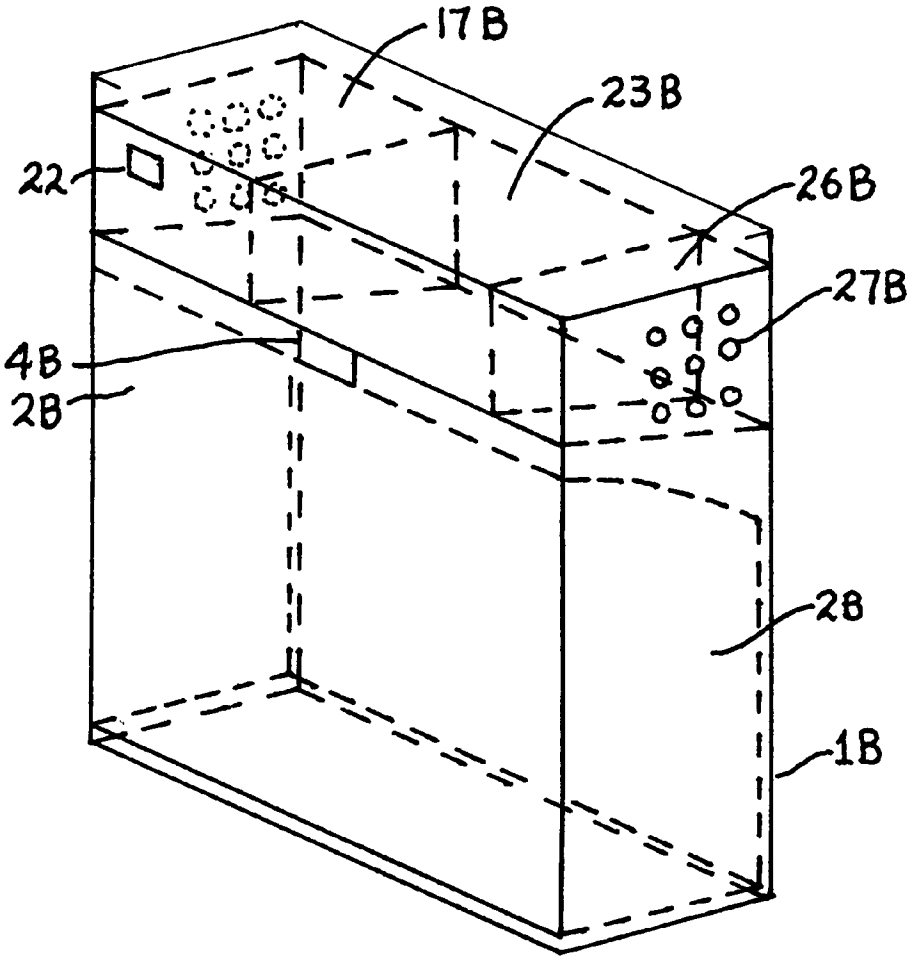
FIG. 7 is a perspective view of a microwave heated towel warmer embodiment embedded in a rock out towel cavity enclosure.

Microwave powered towel warmers are not limited to the trapezoidal embodiment described above but can be placed in a multitude of mechanical enclosures such as that of a rock out towel cavity 28 as illustrated in FIGS. 7 and 8, or in most of the embodiments described in applicants prior U.S. Pat. Nos. 6,046,436 and 6,525,298.

While I have described above the principles of my invention in connection with specific apparatus, it is to be clearly understood that this description is made only by way of example and not as a limitation to the scope of my invention as set forth in the objects thereof and in the accompanying claims.

I claim:

1. A forced hot air towel warmer comprising:

a substantially airtight trapezoidal enclosure having a sealable access means to enable placing a towel and the like to be warmed in the substantially airtight trapezoidal enclosure and to enable removing a warmed towel therefrom;

first means disposed within the substantially airtight trapezoidal enclosure consisting of a rhomboidal cavity inclined front to back to hold the towel to be heated;

second means disposed within the substantially airtight trapezoidal enclosure having air passages there through to support the towel and inclined front to back to promote easy insertion and removal of the towel third means disposed within the substantially air tight trapezoidal enclosure adjacent the second means, containing a temperature sensor and comprising a constant temperature antechamber in which a volume of pressurized air maintained within a predetermined temperature range is caused to continuously impinge on the towel to be heated;

fourth means disposed within the substantially air tight trapezoidal enclosure adjacent the third means to heat the stream of air;

fifth means disposed within the substantially air tight trapezoidal enclosure adjacent the fourth means to pressurize and continuously circulate a stream of air within the substantially air tight trapezoidal enclosure for passage through the first means and the towel;

sixth means disposed within the substantially airtight trapezoidal enclosure having air passages there through to allow air to pass freely upon exiting the towel and inclined from front to rear so as to create a return air plenum and provide an increased height volume at the rear of the unit within the trapezoidal enclosure to contain means four, five and six while presenting the user with a minimal frontal vertical towel entry profile;

seventh means disposed within the substantially airtight trapezoidal enclosure to automatically maintain said stream of air at a temperature within a predetermined temperature range for a given period of time such means consisting of the temperature sensor 14 contained within the third means 8, the door open and close sequential switches 15 and 16 to detect movement of the sealable access means 2, and electronic control circuitry 17 contained within enclosure 18 for timing and temperature control.

2. A towel warmer according to claim 1 further including means associated with said sealable access means to rigidly support said access means when open, in a plane continuous with the second means and thereby to further assist the ease with which the user inserts a towel to be warmed.

3. A towel warmer according to claim 2 further including means associated with said substantially air tight trapezoidal enclosure to enable installation in fixed position bathroom cabinetry.

4. A towel warmer according to claim 2 further including means associated with said substantially air tight trapezoidal enclosure to enable installation in free standing bathroom, nursery, or other appropriate household cabinetry.

* * * * *